US011046105B2

(12) United States Patent
Jolic

(10) Patent No.: US 11,046,105 B2
(45) Date of Patent: Jun. 29, 2021

(54) MICRO-OPTIC DEVICE PROJECTING MULTI CHANNEL PROJECTED IMAGERY

(71) Applicant: CCL Secure Pty Ltd, Craigieburn (AU)

(72) Inventor: Karlo Ivan Jolic, Craigieburn (AU)

(73) Assignee: CCL SECURE PTY LTD, Craigieburn (AU)

( * ) Notice: Subject to any disclaimer, the term of this patent is extended or adjusted under 35 U.S.C. 154(b) by 0 days.

(21) Appl. No.: 16/731,504

(22) Filed: Dec. 31, 2019

(65) Prior Publication Data

US 2020/0130398 A1 Apr. 30, 2020

Related U.S. Application Data

(63) Continuation of application No. PCT/AU2018/050684, filed on Jul. 3, 2018.

(30) Foreign Application Priority Data

Jul. 3, 2017 (AU) ..... 2017100907

(51) Int. Cl.
*B42D 25/324* (2014.01)
*B42D 25/425* (2014.01)
(Continued)

(52) U.S. Cl.
CPC ..... *B42D 25/324* (2014.10); *B42D 25/425* (2014.10); *B42D 25/21* (2014.10);
(Continued)

(58) Field of Classification Search
CPC .... B42D 25/324; B42D 25/425; B42D 25/21; B42D 25/328; B42D 25/351;
(Continued)

(56) References Cited

U.S. PATENT DOCUMENTS

2010/0309204 A1 12/2010 Smith et al.
2012/0268598 A1 10/2012 Holmes et al.
(Continued)

FOREIGN PATENT DOCUMENTS

AU 2012100265 A4 4/2012
AU 2012101592 A4 11/2012
(Continued)

OTHER PUBLICATIONS

PCT International Search Report and Written Opinion, PCT Application No. PCT/AU2018/050684, dated Sep. 20, 2018, 15 pages.

*Primary Examiner* — Justin V Lewis
(74) *Attorney, Agent, or Firm* — Fenwick & West LLP

(57) ABSTRACT

A micro-optic device, including: a substrate; a plurality of image elements in an image plane; and a plurality of focusing elements, each focusing element focusing light to a focal point on the image plane and magnifying any portion of an image element falling within the focal point to thereby produce an image pixel projected to a user at one or more viewing angles, the focal point having an extent smaller than the image element, wherein each image element includes an image sub-element having a different discernible level of brightness to elsewhere in the image element, the brightness of each projected image pixel being dependent on the proportion of the focal point filled with the image sub-element, and wherein each image sub-element has one or more attributes in the image plane, such that, from a given viewing angle, the brightness of each projected image pixel is dependent on each attribute of each image sub-element.

22 Claims, 9 Drawing Sheets

(51) Int. Cl.

| | |
|---|---|
| ***B42D 25/21*** | (2014.01) |
| ***B42D 25/328*** | (2014.01) |
| ***B42D 25/351*** | (2014.01) |
| ***B42D 25/355*** | (2014.01) |
| ***B42D 25/364*** | (2014.01) |
| ***B42D 25/378*** | (2014.01) |
| ***G07D 7/12*** | (2016.01) |
| ***G07D 7/00*** | (2016.01) |
| ***G07D 7/207*** | (2016.01) |

(52) U.S. Cl.
CPC ..... *B42D 25/328* (2014.10); *B42D 25/351* (2014.10); *B42D 25/355* (2014.10); *B42D 25/364* (2014.10); *B42D 25/378* (2014.10)

(58) Field of Classification Search
CPC .. B42D 25/355; B42D 25/364; B42D 25/378; G07D 7/12; G07D 7/003; G07D 7/207
USPC ..... 283/72, 74, 94, 98, 99, 109, 110, 901
See application file for complete search history.

(56) References Cited

U.S. PATENT DOCUMENTS

| | | | | |
|---|---|---|---|---|
| 2013/0155519 | A1 | 6/2013 | Jolic | |
| 2014/0353959 | A1* | 12/2014 | Lochbihler ..... | B42D 25/29 283/85 |
| 2015/0070350 | A1 | 3/2015 | Cape et al. | |
| 2015/0352882 | A1 | 12/2015 | Jolic | |

FOREIGN PATENT DOCUMENTS

| | | | |
|---|---|---|---|
| WO | WO 2008/008635 | A2 | 1/2008 |
| WO | WO 2017/100838 | A1 | 6/2017 |

* cited by examiner

MICRO-OPTIC DEVICE PROJECTING MULTI CHANNEL PROJECTED IMAGERY

CROSS-REFERENCE TO RELATED APPLICATIONS

This application is a bypass continuation application of International Patent Application No. PCT/AU2018/050684 filed on Jul. 3, 2018, which claims priority to Australian Patent Application No. 2017100907 filed on Jul. 3, 2017, which are incorporated by reference herein in their entirety.

TECHNICAL FIELD

The present invention relates to a micro-optic device for use in a micro-optic image presentation system. Embodiments of the invention can be used as a security device for bank notes and coins, credit cards, cheques, passports, identity cards, and the like, and it will be convenient to describe the invention in relation to that exemplary, non-limiting application.

BACKGROUND OF INVENTION

It is well known that many of the world's bank notes, as well as other security documents, bear security devices which produce optical effects enabling a visual authentication of the bank note. Some of these security devices include focusing elements, such as micro lenses, which act to sample and magnify image elements and project imagery which is observable to a user for authentication purposes.

Conventional multichannel optically variable imagery produced by micro-lens based security features may be achieved by applying micro-image elements underneath a one-dimensional (1D) array of micro-lenticular lenses, usually in their focal plane, or substantially close to it. The conventional scenario is that the lens width is roughly an integer multiple of the minimum width of an image element, which means that the maximum number of image channels possible is equal to the width of each micro-lens-let divided by the minimum width of each micro-image element. For example, if the micro-lens-lets are each 50 microns wide, and the minimum image element size is 25 microns, this means only 2 image channels can be created with this method (50/25=2).

A disadvantage of the aforementioned conventional approach is that the maximum number of image channels is limited by the ratio of the lens width to the width of the minimum image element size. The problem is, the fewer the number of image channels there are, the easier it is for the security feature to be copied or simulated by a counterfeiter.

The problem of only a limited number of image channels being available has been addressed in the past by offsetting each image element relative to the vertex of its corresponding lenticule, in order to increase the number of image channels. The image content that is projected to the user will depend on the user's viewing angle and the offset distances used for the image elements. The number of unique image channels is equal to the number of unique offset distances available; the latter is defined by the addressability of the origination method used to make the imagery tooling. The maximum number of offset distances/imagery channels that can be generated is equal to the width of each lens-let divided by the addressability (i e minimum step size) of the origination method used to make the imagery tooling. For example, if the lens width is 50 microns, and the minimum step size of the origination method is 5 microns, this means 50/5=10 image channels (maximum) can be created, this increases the copy resistance of the security feature. For more detail on how this works, see patent "Multichannel optically variable images" (WO2012024718).

The above "offset" approach is particularly useful when the image elements are not very small compared to the lenses; this will be the case if the micro-lenses are for banknotes and the imagery is to be printed with standard printing methods such as gravure, flexographic or offset. For example, if the minimum size of the image elements is around 50% of the width of each lens-let, the conventional imagery design approach would yield only 2 image channels, whereas the "offset" method would yield 10 image channels (assuming 50 micron lens-lets and 5 micron origination addressability). The offset method is therefore particularly advantageous if the image elements are applied by printing (for example, by gravure printing) and if the micro-lenses form part of a security document such as a banknote (because in this scenario, the image elements are not very small compared to the micro-lenses).

However, a limitation of the "offset" multichannel method is that it can only be applied to imagery designs developed for lenticular lens arrays i.e. for 1-D arrays of cylindrical or elliptical lenses. This causes a problem, because if the security device is tilted about an axis that is perpendicular to the axes of the micro-lenses, the image projected to the user will not change. This is disadvantageous because it makes the authentication process difficult.

For example, if the lenticular device has multiple image channels, and the banknote is held so that the lenses are oriented vertically to the user (and perpendicular to the user's line of sight), and the user then tilts the banknote about a horizontal axis (i.e. towards and away from them—in order to authenticate) the image projected to the user will not change, and they may erroneously conclude that the security device is not authentic.

This scenario would commonly occur, because the user will typically hold the banknote in landscape orientation, and then naturally tend to tilt it towards or away from them to conduct authentication. If the landscape-oriented banknote has a multichannel lenticular image security feature on it, with lenses oriented vertically on it, the image projected to the user during tilting would not change, potentially leading the user to conclude that the banknote is not authentic.

It would be therefore be desirable to provide a multichannel micro-optic device which projects an optically variable image to the user when tilting the banknote about the vertical axis or the horizontal axis or about any other intermediate axis, thus enabling easier authentication.

It would also be desirable to provide a multi-channel micro-optic device that can be easily and/or inexpensively manufactured, and in some embodiments can be printed via standard print methods such as gravure, flexographic or offset techniques.

It would also be desirable to provide a micro-optic device including focusing elements and corresponding image elements that ameliorates or overcomes one or more disadvantages or inconveniences of known micro-optic devices.

SUMMARY OF INVENTION

One aspect of the invention provides micro-optic device for projecting an image, the device including: a substrate; a plurality of image elements in an image plane; and a plurality of focusing elements arranged in a two dimensional array, each focusing element focusing light to a focal point on the image plane and magnifying any portion of an image element falling within the focal point to thereby produce a projected image pixel projected to a user at a plurality of viewing angles, the focal point having an extent smaller than the image element, wherein each image element including an image sub-element discernible from elsewhere in the image element, the brightness of each projected image pixel being dependent on the proportion of the focal point filled with the image sub-element, wherein each image sub-element has one or more attributes in the image plane and the or each attribute corresponds to a pre-defined brightness at a particular angle of view, such that the projected image pixels together project the image, and at other angles of view the brightness of the projected image pixel varies, in a defined relationship according to the or each attribute, and wherein image pixels having a same brightness at a particular angle of view are produced by image elements having sub-elements with identical attributes.

In one or more embodiments, the proportion of the image sub-element falling within the focal point changes when seen from different viewing angles.

In one or more embodiments, the first attribute of each image sub-element is a function of a grey-level value of a location corresponding to that image sub-element in a first greyscale image.

In one or more embodiments, a second attribute of each image sub-element is a function of a grey-level value of a location corresponding to that image sub-element in a second greyscale image.

In one or more embodiments, the one or more attributes of the image sub-elements include any one or more of angular orientation, shape, length thickness and area.

In one or more embodiments, each image sub-element has a shape, and wherein one of the attributes is the angular orientation of the shape.

In one or more embodiments, each image sub-element has the same shape.

In one or more embodiments, each image sub-element is a half disk occupying half of an image element.

In one or more embodiments, the device produces a contrast switching effect when from seen from the different viewing angles.

In one or more embodiments, each image sub-element has a shape, and wherein one of the attributes is the area of the shape.

In one or more embodiments, the device produces a disappearing image effect when from seen from the different viewing angles.

In one or more embodiments, the plurality of image elements and the plurality of focusing elements are located on opposite sides of the substrate.

In one or more embodiments, the plurality of image elements and the plurality of focusing elements are located on a first side of the substrate, the micro-optic device further including a layer of reflective material to direct light from the focusing elements to the image elements.

In one or more embodiments, a first group of the focusing elements and a first group of the image elements are integrated into a first unitary structure on a first side of the substrate.

In one or more embodiments, a second group of the focusing elements and a second group of the image elements are integrated into a second unitary structure on a second side of the substrate, and wherein the first group of the focusing elements causes the second group of the image elements to be magnified.

In one or more embodiments, the image sub-elements are formed by any one of gravure, flexographic and offset printing techniques.

In one or more embodiments, the image sub-elements are formed by embossing or other microstructure forming technique.

In one or more embodiments, the image sub-elements are recessed or protrude from surrounding surfaces.

In one or more embodiments, the image sub-elements include any one or more of gratings, high roughness microtexture and textured microstructures.

In one or more embodiments, the image sub-elements have a surface that is oblique relative to the plane of surrounding surfaces.

In one or more embodiments, the plurality of image elements and the plurality of focusing elements each form a two-dimensional array.

Another aspect of the invention provides a security device including a micro-optic device as described hereabove.

Another aspect of the invention provides a security document including a security device as described hereabove.

BRIEF DESCRIPTION OF DRAWINGS

Preferred embodiments of the invention will now be described by way of example only with reference to the accompanying drawings in which.

DETAILED DESCRIPTION

Definitions

Security Document or Token

Figure 1:
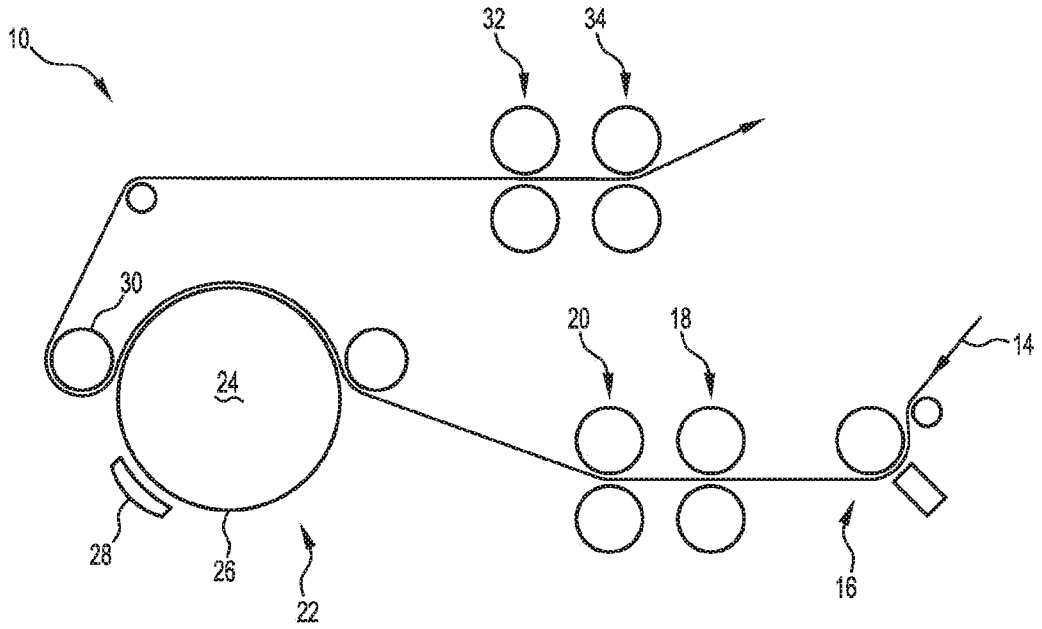
FIG. 1 is a schematic diagram of one embodiment of an apparatus for in-line manufacturing part of a security document.

As used herein, the terms security documents and tokens includes all types of documents and tokens of value and identification documents including, but not limited to the following: items of currency such as bank notes and coins, credit cards, cheques, passports, identity cards, securities and share certificates, driver's licences, deeds of title, travel documents such as airline and train tickets, entrance cards and tickets, birth, death and marriage certificates, and academic transcripts.

The invention is particularly, but not exclusively, applicable to security devices, for authenticating items, documents or tokens, such as bank notes, or identification documents, such as Identity cards or passports, formed from a substrate to which one or more layers of printing are applied.

More broadly, the invention is applicable to a micro-optic device which, in various embodiments, is suitable for visual enhancement of clothing, skin products, documents, printed matter, manufactured goods, merchandising systems, packaging, point of purchase displays, publications, advertising devices, sporting goods, security documents and tokens, financial documents and transaction cards, and other goods.

Security Device or Feature

As used herein, the term security device or feature includes any one of a large number of security devices, elements or features intending to protect security document or token from counterfeiting, copying, alteration or tampering. Security devices or features may be provided in or on the substrate of the security document or in or on one or more layers applied to the base substrate, and may take a wide variety of forms such as security threads embedded in layers of the security document; security inks such as fluorescent, luminescent or phosphorescent inks, metallic inks, iridescent inks, photochromic, thermochromic, hydrochromic, or peizochromic inks; printed or embossed features including release structures; interference layers; liquid crystal devices; lenses and lenticular structures; optically variable devices (OVDs) such as diffractive devices including diffraction gradients, holograms and diffractive optical elements (DOEs).

Substrate

As used herein, the term substrate refers to the base material from which the security document or token is formed. The base material may be paper or other fibrous materials such as cellulous; a plastic or polymeric material including but not limited to polypropylene (PP), polyethylene (PE), polycarbonate (PC), polyvinyl chloride (PVC), polyethylene terephthalate (PET), biaxially-oriented polypropylene (BOPP); or a composite material of two or more materials, such as a laminate of paper and at least one plastic material, or of two or more polymeric materials.

Transparent Windows and Half Windows

As used herein, the term window refers to a transparent or translucent area in the security document compared to the opaque region to which printing is applied. The window maybe fully transparent so as to allow the transmission of light substantially unaffected, or it may be partly transparent or translucent, partly allowing the transmission of light but without allowing objects to be seen clearly through the window area.

A window area may be formed in a polymeric security document which has at least one layer of transparent polymeric material and one or more opacifying layers applied to at least one side of a transparent polymeric substrate, by omitting at least one opacifying layer in the region forming the window area. If opacifying layers are applied to both sides of a transparent substrate, a fully transparent window may be formed by omitting the opacifying layers on both sides of the transparent substrate in the window area.

A partly transparent or translucent area herein after referred to as a "half-window", may be formed in a polymeric security document which has opacifying layers on both sides by omitting the opacifying layers on one side only of the security document in the window area so that "half-window" is not fully transparent but allows sunlight to pass through without allowing objects to be viewed clearly through the half-window.

Alternatively, it is possible for the substrates to be formed from a substantially opaque material, such as paper or fibrous material, with an insert of transparent plastics material inserted into a cut out or recessed into the paper or fibrous substrate to form a transparent window or a translucent half-window area.

Opacifying Layers

One or more opacifying layers may be applied to a transparent substrate to increase the opacity of the security document. An opacifying layer is such that $L_T<L_0$ where $L_0$ is the amount of light incident on the document, and $L_T$ is the amount of light transmitted through the document. An opacifying layer may comprise any one or more of a variety of opacifying coatings. For example, the opacifying coatings may comprise a pigment, such as titanium dioxide, dispersed within a binder or carrier of heat-activated cross-linkable polymeric material. Alternatively, a substrate of transparent plastic material could be sandwiched between opacifying layers of paper or other partially or substantially opaque material to which indicia may be subsequently printed or otherwise applied.

Focusing Elements

One or more focusing elements may be applied to the substrate of the security device. As used herein, the term "focusing element" refers to devices that focus light towards, or cause light to be diverged from or constructively interfere at a real or imaginary focal point. Focusing elements include refractive lenses that focus incoming light to a real focal point in a real focal plane or to a virtual focal point in a virtual focal plane and also collimate light scattered from any point in the focal plane to a particular direction. Focusing elements also include convex reflective elements having a virtual focal point where incoming substantially collimated light appears to diverge from that single virtual focal point. Focusing elements also include transmissive or reflective diffractive lenses, zone plates and the like that cause the transmitted or reflected diffracted light to constructively interfere at a desired real or virtual focal point.

Figure 2:
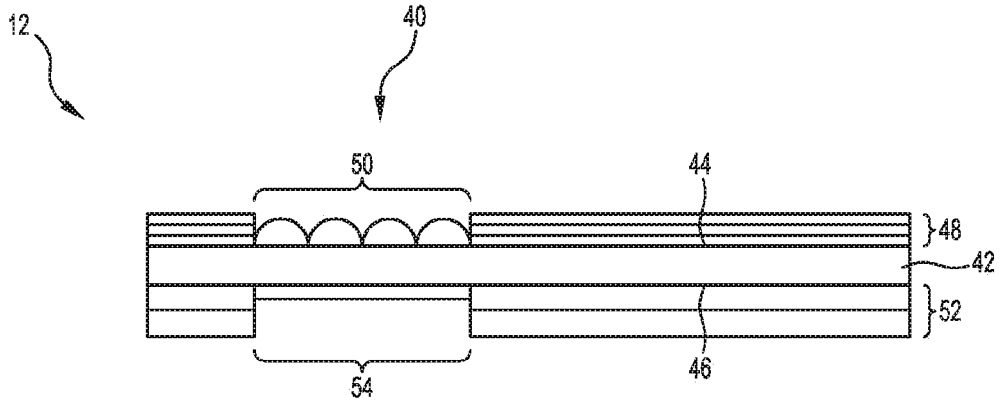
FIG. 2 is a cutaway side view of the partially manufactured security document manufactured by the apparatus of FIG. 1.

FIG. 1 shows an exemplary apparatus 10 for in-line manufacturing part of an exemplary document 12 depicted in FIG. 2. A continuous web 14 of translucent or transparent material such as polypropylene or PET is subject to an adhesion promoting process at a first processing station 16 including a roller assembly. Suitable adhesion promoting processes include flame treatment, corona discharge treatment, plasma treatment or similar.

An adhesion promoting layer is applied at a second processing station 18 including a roller assembly. A suitable adhesion promoting layer is one specifically adapted for the promotion of an adhesion of UV-curable coatings to polymeric surfaces. The adhesion promoting layer may have a UV curing layer, a solvent-based layer, a water-based layer or any combination of these.

At a third processing station 20 which also includes a roller assembly, the radiation sensitive coating is applied to the surface of the adhesion promoting layer. The radiation sensitive coating can be applied via flexographic printing, gravure printing or a silk screen printing process and variations thereof amongst other printing processes.

The radiation sensitive coating is only applied to a security element area on a first surface of the web where an array of lens elements is to be positioned. The security element area can take the form of a stripe, a discrete patch in the form of simple geometric shape or in the form of a more complex graphical design.

While the radiation sensitive coating is still, at least partially, liquid, it is processed to form the array of lens elements at a fourth processing station 22. In one embodiment, the processing station 22 includes an embossing roller 24 for embossing a security element structure into the radiation sensitive coating. The cylindrical embossing surface 26 has surface relief formations corresponding to the shape of the structure to be formed. In one embodiment, the surface relief formations can orient the array of lens elements and the array of image elements in the machine direction, transverse to the machine direction, or in multiple directions at an angle to the machine direction. The apparatus 10 can form micro lenses and micro-imagery elements in a variety of shapes.

The cylindrical embossing surface 26 of the embossing roller 24 may have a repeating pattern of surface relief formations or the relief structure formations may be localized to individual shapes corresponding to the shape of the security elements area on the web. The embossing roller 24 may have the surface relief formations formed by a diamond stylus of appropriate cross section, or by direct laser engraving or chemical etching, or the surface relief formations may be provided by at least one embossing shim 28 provided on the embossing roller 24. The embossing shim may be attached via adhesive tape, magnetic tape, clamps or other appropriate mounting techniques.

The UV-curable ink on the web is brought into intimate contact with the cylindrical embossing surface 26 of the embossing roller 24 by a UV roller 30 at processing station 22 such that the liquid UV-curable ink flows into the surface relief formations of the cylindrical embossing surface 26. At this stage, the UV-curable ink is exposed to UV radiation, for example, by transmission through the web.

With the security element structure applied to the web, one or more additional layers are applied at a downstream processing station including further roller assemblies 32 and 34. The additional layers may be clear or pigmented coatings and applied as partial coating, as a contiguous coating or accommodation of both. In one preferred method, the additional layers are opacifying layers which are applied to one or both surfaces of the web except in the region of the security element structure.

FIG. 2 shows a partially manufactured document 12 including a micro-optic device 40 having an array of focusing elements and an array of image elements which, in this example, are formed on opposite sides of transparent or partially transparent substrate 42. The substrate is a polymeric material, preferably an axially orientated polypropylene (BOPP), having a first surface 44 and a second surface 46.

Opacifying layers 48 are applied to the first surface 44, except in a window area 50 where the focusing elements of the micro-optic device 40 are applied to the first surface 44. Opacifying layers 52 are applied to the second surface 46 except in a window area 54. The window area 54 substantially coincides with the window area 50. A printed layer is applied to the second surface 46 in the window area 54 in order to form the image elements of the micro-optic device 40.

Figure 3:
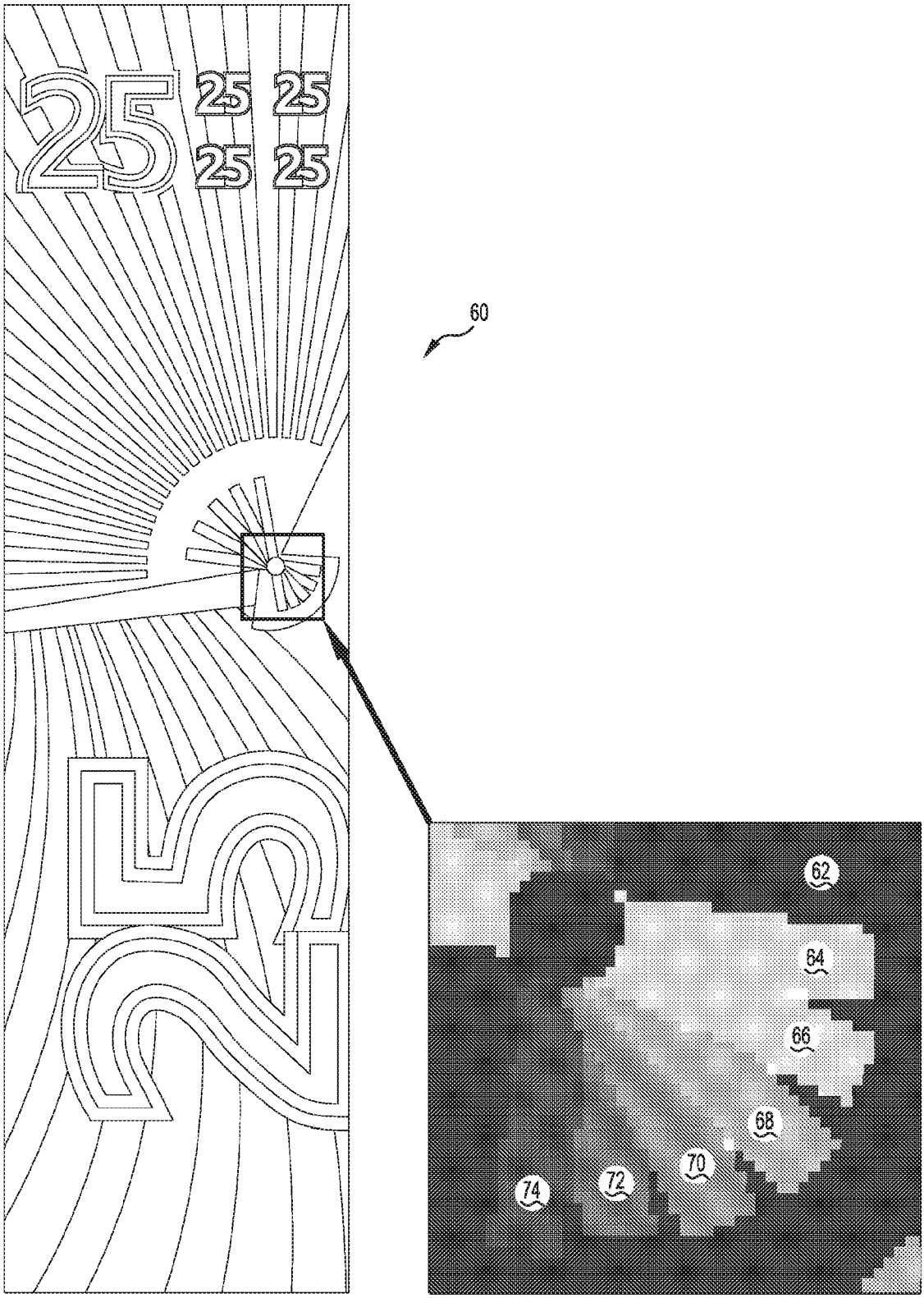
FIG. 3 is an exemplary greyscale input image.

FIG. 3 shows an exemplary 8-bit grey-level greyscale input image 60 and a magnified view of a portion 62 of that input image. The micro-optic device 40 acts to project a transformed version of the input image to a user at one or more viewing angles. This particular example image has 12 discrete grey levels that range from 0 up to 229 units of grey. Exemplary image zones 64 to 74 have different grey-level values.

Figure 4:
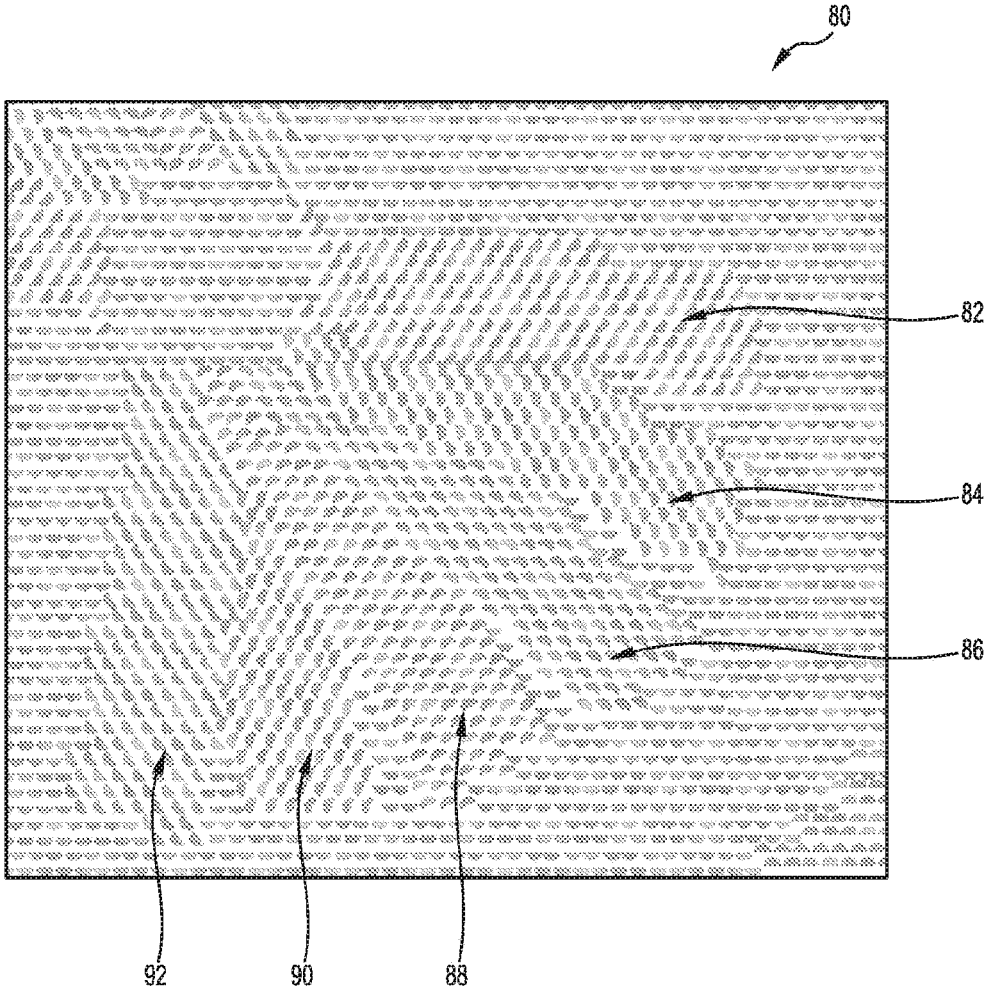
FIG. 4 is an array of image sub-elements corresponding to the magnified view of a portion of the input image of FIG. 3.

FIG. 4 shows an array 80 of half-disk shapes corresponding to the magnified view of a portion 62 of the input image. The half-disk shapes are arranged in groups each having a common angular orientation. Representative half-disk groups 82 to 92 respectively correspond to the image zones 64 to 74 depicted in FIG. 3. The angular orientation of the half-disks in each group is a function of the grey-level value of the corresponding image zone. It can be seen from FIGS. 3 and 4 that as the input grey-level value increases (i.e. as the input image becomes brighter) the angular orientation of each half disk increases in the clockwise direction.

Figure 5:
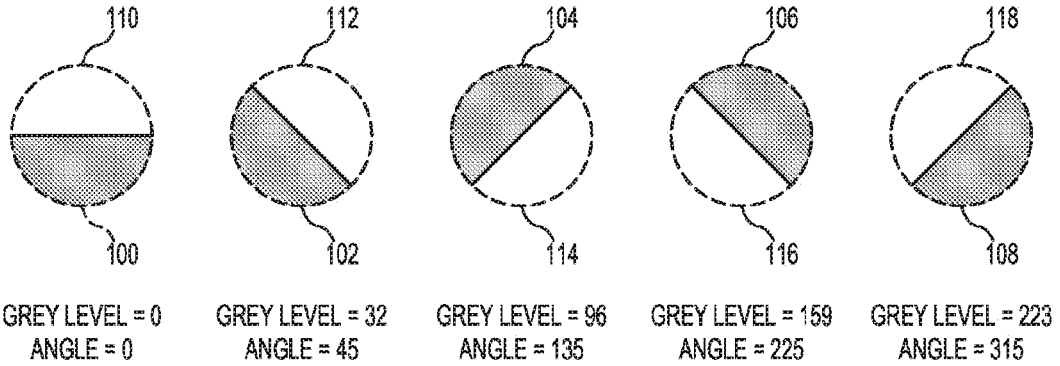
FIGS. 5 to 7 depicts a range of angular orientations of image sub-elements of the type shown in FIG. 4.

FIG. 5 depicts five exemplary half-disks 100 to 108 having different angular orientations from each other. The straight edge of the half-disk 100 has a 0 degree angular orientation corresponding to a grey-level value of 0, the straight edge of the half-disk 102 has a 45 degree angular orientation corresponding to a grey-level value of 32, the straight edge of the half-disk 104 has a 135 degree angular orientation corresponding to a grey-level value of 96, the straight edge of the half-disk 106 has a 225 degree angular orientation corresponding to a grey-level value of 159 and the straight edge of the half-disk 108 has a 315 degree angular orientation corresponding to a grey-level value of 223.

Each half-disk 100 to 108 functions as an image sub-element respectively within a larger notional image element 110 to 118. In this embodiment, the image elements 110 to 118 have a full-disk shape. Each half-disk 100 to 108 is depicted as being black—completely opaque and non-reflective—whereas the remainder of each larger image element 110 to 118 is depicted as white—maximally reflective.

Figure 6:
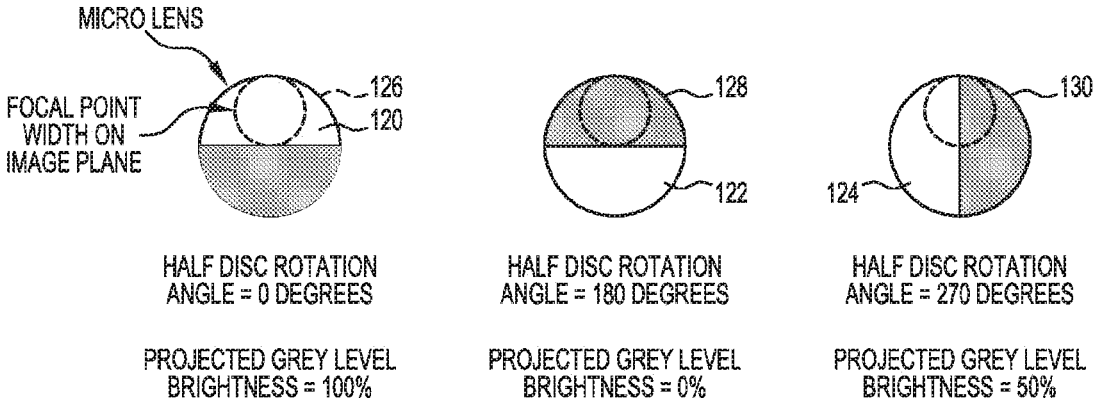

In use, each focusing element focuses light to a focal point on an image plane and magnifies any portion of an image element falling within the focal point to thereby produce an image pixel projected to a user at one or more viewing angles. FIG. 6 depicts three image elements 120 to 124 respectively having the same dimensions as and being superposed with focusing elements 126 to 130.

All real lenses do not focus light rays perfectly, and even at best focus, a "focal point" has the form of a spot rather than a point. All focal points therefore have a width or extent in an image plane. However, the focusing elements 126 to 130 are configured to have a focal point which is appropriate for this invention, which is typically larger than if it was intended to provide "best focus".

In this example, the grid axes of the focusing elements and image elements are parallel to each other and have zero relative offset in the image plane, and the focal point width of the focusing element is approximately equal to half of the image element width, and the viewing angle of the user is such that the focal point width is located in the top half of the image plane for each micro-lens. Accordingly, the micro-optic device is configured so that the focal points of the focusing elements 126 to 130 have an extent smaller than the image elements 120 to 124. In the non-limiting example shown in FIG. 6, the focal point width is approximately half the image element width.

The brightness of each projected image pixel is dependent on the proportion of the focal point filled with the image sub-element. As can be seen in FIG. 6, under identical view conditions in which the focal point falls within the upper half of the image element, the projected image pixel can vary from a 100% projected grey-scale level to a 0% grey-scale level depending on the angular orientation of the half-disk within the corresponding image element.

Figure 7:
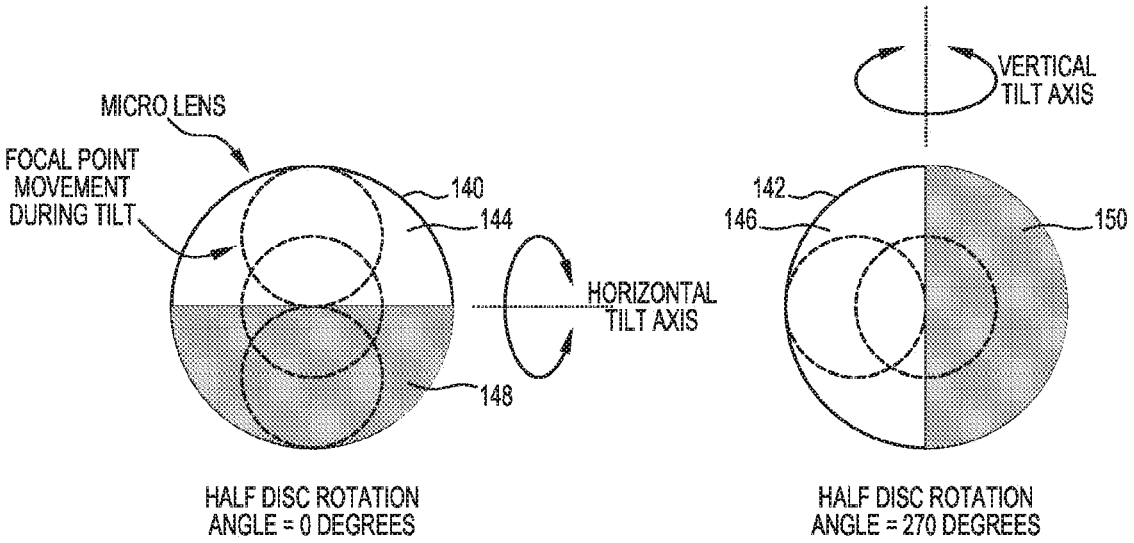

Furthermore, the proportion of the focal point filled with the image sub-element changes when the micro-optic device is viewed from different viewing angles, thereby enabling multiple image channels to be observed by a user. FIG. 7 shows two focusing elements 140 and 142 respectively the same size as and overlying image elements 144 and 146. The straight edge of the half-disk sub-image element 148 of the image element 144 has an angular orientation of zero degrees, whereas the straight edge of the half-disk sub-image element 150 of the image element 146 has an angular orientation of 270 degrees.

Rotation of a document bearing the micro-optic device will change the viewing angle of a user. Rotation of a document bearing the micro-optic device about a horizontal tilt axis will cause the focal point of the focusing element 140 to travel between opposite boundaries of the image element 144, thus causing the projected image pixel to vary from a 100% projected grey-scale level to a 0% grey-scale level. Similarly, rotation of a document bearing the micro-optic device about a vertical tilt axis will cause the focal point of the focusing element 142 to travel between opposite boundaries of the image element 146, also causing the projected image pixel to vary from a 100% projected grey-scale level to a 0% grey-scale level.

FIG. 7 also demonstrates how using a minimum of 2 different angular orientations for the half disks, wherein the difference between the 2 angles in not an integer multiple of 180 degrees, will ensure that an optically variable image is projected to the user when the device is tilted, regardless of the orientation of the tilt axis used. The half disk 148 can produce an optically variable image by tilting about any axis except the vertical axis, whereas the half disk 150 can produce an optically variable image by tilting about any axis except the horizontal axis. A design including half disks with both angles means authentication can be performed by tilting about any axis.

Figure 8:
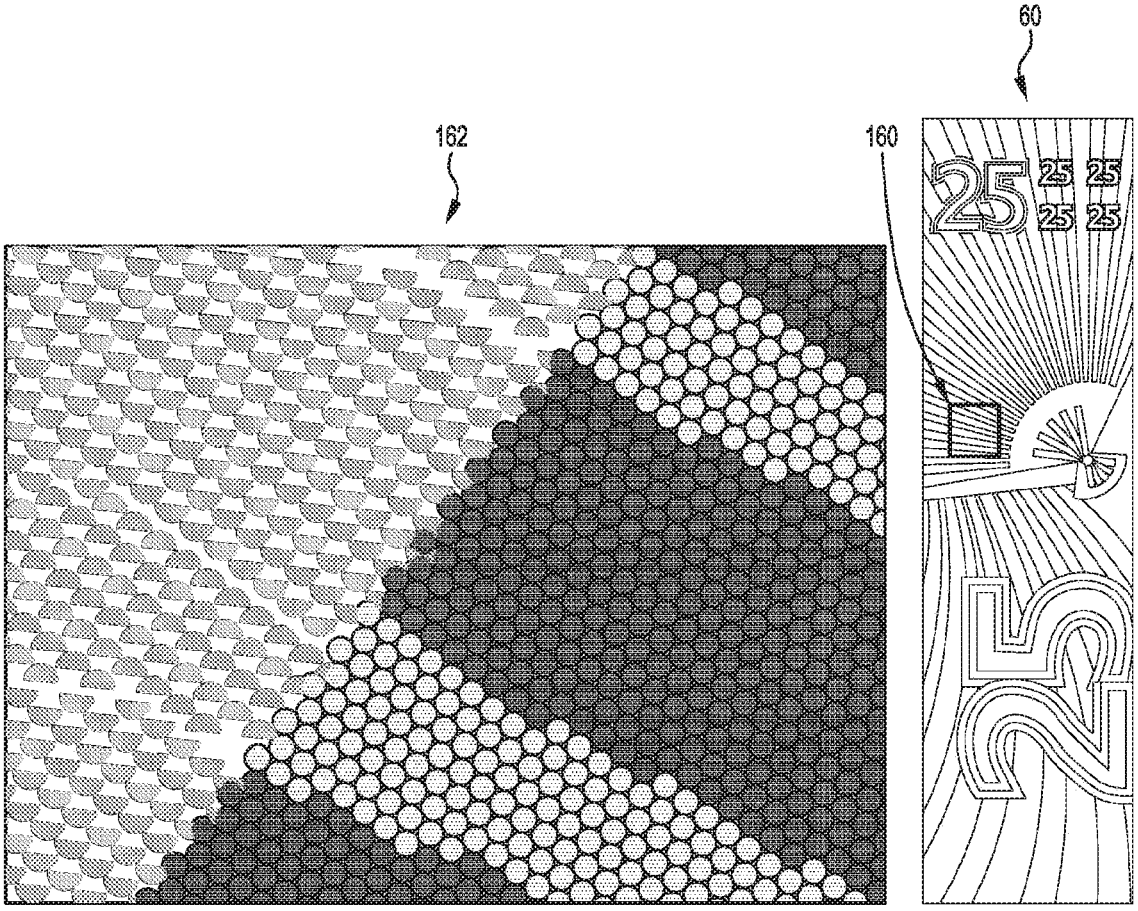
FIG. 8 is an image of part of a micro-optic device, including an array of focusing elements overlaying an array of image elements for projecting an image corresponding to the input image shown in FIG. 3.

FIG. 8 is an image 162 of a two-dimensional hexagonal array of focusing elements (with a 64 microns hexagonal pitch) on a 90 micron thick polymer substrate, overlayed on a two-dimensional hexagonal array of image elements, including half-disk sub-image elements, forming a portion 162 of the input image 60. The focusing elements and image elements are aligned so that the hexagonal axes of the focusing elements and image elements are parallel to each other. Each focusing element produces an image pixel projected to the user, by focusing on the image layer beneath it, and magnifying any portion of an image element that falls within the focal point width of the focusing element.

The brightness of the image pixel projected to the user will depend on (i) the viewing angle of the user; and (ii) the angular orientation of the half disk; and (iii) the offset (in the image plane) of the focusing element array hexagonal grid axes relative to the half-disk array hexagonal grid axes. In FIG. 8, some areas of the focusing element array are located so that their lens focal points lie within the circular half disks (thus projecting dark image pixels i.e. projected brightness=0%), whereas other areas of the micro-lens array are located so that their lens focal points lie outside the circular half disks (thus projecting bright image pixels i.e. projected brightness=100%).

It is to be understood that the preceding embodiments are exemplary only, and that variations to these embodiments include the following:

a) each image element can include an image sub-element having a different discernible level of brightness to elsewhere in the image element, and that black and white are merely two such different discernible level of brightness
b) the image sub-elements can have shapes other than a half-disk
c) whilst the shapes of the image sub-elements are most conveniently identical, this need not always be the case
d) the sub-image element can occupy half the image element or some other portion
e) the focal point width can be half image element width but may also be some other value.

Furthermore, apart from varying their angular orientation in accordance with an input greyscale image, one or more other attributes of the image sub-elements could additionally or alternatively be varied in accordance with an input grey level image. The grey scale image used for the other attribute may be same image used for varying the angular orientation, or it could be a different input image.

Figure 13:
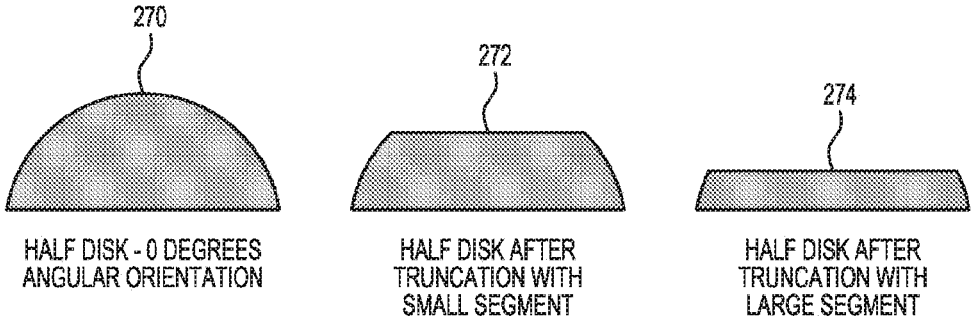
FIG. 13 is another example of image sub-elements for use in a micro-optic device.

One such example is shown in FIG. 13, which depicts half disks 270, 272 and 274 that have different shapes. Half-disks 272 and 274 have each had a segment portion truncated from them, that is, a segment is truncated/removed from the half disk and the straight edge of the half disk is preserved after truncation. The segment truncated may be selected so that the thickness dimension of the truncated half disk depends on a greyscale input image. This allows the creation of an optional secondary non-magnified image that is observable by viewing the imagery layer directly.

In FIG. 13, the straight edges of each half disk are depicted having the same angular orientation, however varying angular orientations may be used, for example the angular orientations may be varied in accordance with an input grey level image.

In an alternative embodiment, the segment truncated may be selected so that the area of the half disk depends on a greyscale input image. For example, the area of each half disk, after truncation, may be proportional to a corresponding grey level in another greyscale input image. This allows the greyscale input image to be implemented as a secondary non-magnified image that is observable by viewing the imagery layer directly.

As has been explained previously, the hexagonal array 80 of half disks shown in FIG. 4 have an angular orientation proportional to grey levels in the input grey level image 60 shown in FIG. 3. When the imagery in FIG. 4 is overlayed with a set of hexagonal micro lenses with appropriate pitch and focal length, the projected image seen through the micro-lenses at one viewing angle will correspond to the image portion 62 and at another viewing angle will correspond to the inverse of the image portion 62 i.e. the contrast inverted image of the image portion 62 will be projected to the viewer.

When the imagery consisting of rotated half disks (FIG. 4) is viewed directly (not as a magnified image viewed through the lenses) a faint image of the image shown in FIG. 3 may be discerned if viewed very closely with the naked eye, however in general the user will perceive a constant level of grey in the imagery area i.e the image shown in FIG. 3 will not be easily discernable in a lens-based security feature implemented on a banknote, since the image elements concerned are very small.

Figure 14:
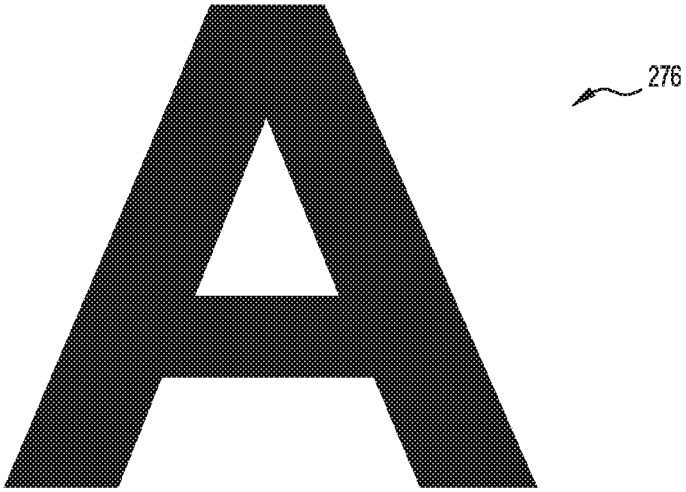
FIG. 14 is another exemplary greyscale input image.
Figure 15:
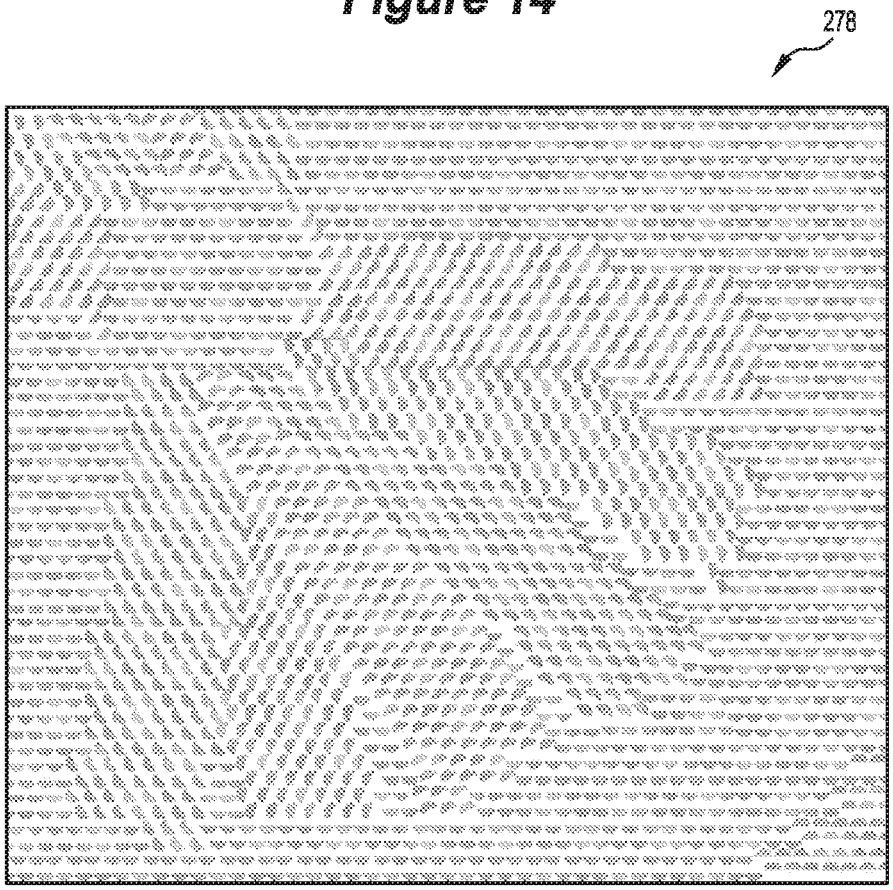
FIG. 15 is an array of image sub-elements encoding both of the target greyscale input images shown in FIGS. 3 and 14.

However the area of each half disk of the array 80 can also be varied in accordance with a secondary image, such as the image 276 (an image of the letter "A") shown in FIG. 14, resulting in the image 278 i.e. an array of half disks in which the angular orientation of each half disk is in accordance with the grey level image shown in FIG. 3, and the area of each half disk is in accordance with the grey level image shown in FIG. 14. Half disks in FIG. 15 corresponding to white areas in FIG. 14 have smaller area than half-disks in FIG. 15 corresponding to black areas in FIG. 14. Since all half disks have the same pitch, a contrasting image of the letter "A" is formed in the imagery layer shown in FIG. 15.

By constructing the imagery layer in this way, then in addition to producing a contrast inverting image of FIG. 3 that is viewable from the lens side of the substrate, a non-magnified secondary image that may be observed by viewing the imagery layer directly is also implemented i.e. by viewing from the lens reverse side of the substrate the user will now be able to easily perceive an image of the letter "A". In this way additional design elements observable on the reverse side of the lenses are introduced in a lens-based security feature while at the same time preserving the magnified optical effect imagery observable from the other side.

For example, the other attribute could be the area of the image sub-elements as illustrated in the examples shown in FIGS. 3, 4, 14 and 15. Alternatively, the other attribute could be one of the image sub-element dimensions, for example the width of the truncated half disk as discussed in the FIG. 13 example. The other attribute could also be the length dimension of the image element.

The above-mentioned approach enables a static image to be encoded, as an additional design element, into the imagery layer of the device. The static image can be observed by viewing the imagery layer directly rather than through the lenses.

In the above-described examples, the plurality of image elements and the plurality of corresponding focusing elements each form a two-dimensional array. However, in other embodiments of the invention, the image elements and/or the focusing elements could be arranged in 1D arrays.

Figure 9:
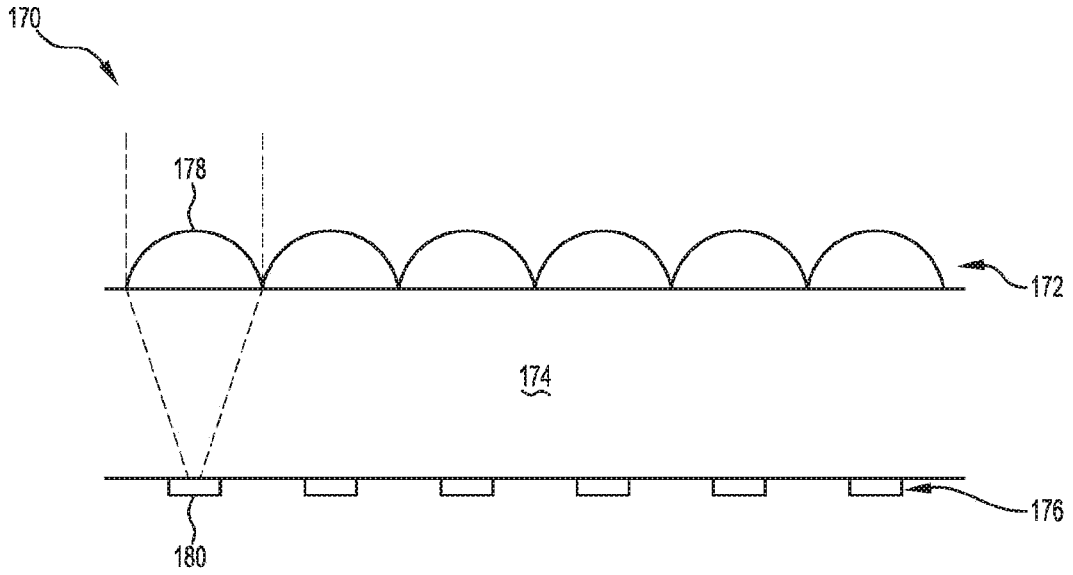
FIGS. 9 to 12 show four different embodiments of a micro-optic device.

FIGS. 9 to 12 depict four exemplary embodiments of a micro-optic device providing at least some of the above-described functionality. FIG. 9 shows a "single-sided" device 170 manufactured according to the process described and depicted in relation to FIGS. 1 and 2. The micro-optic device 170 includes an array 172 of focusing elements applied to one side of a transparent or partially transparent substrate 174 and a corresponding array of image elements 176 applied to the other side of the substrate 174. Typically, the focusing elements are embossed by the process described in relation to FIGS. 1 and 2. Typically, the imagery 104 is printed and/or embossed in a separate additional process.

Each focusing element—such a focusing element 178—focuses light to a focal point on the image plane and magnifies any portion of an image element—such as image element 180—falling within the focal point to thereby produce an image pixel projected to a user at one or more viewing angles from the first side of the substrate. Each image element includes an image sub-element having a different discernible level of brightness to elsewhere in the image element, and the brightness of each projected image pixel is dependent on the proportion of the focal point filled with the image sub-element.

Figure 10:
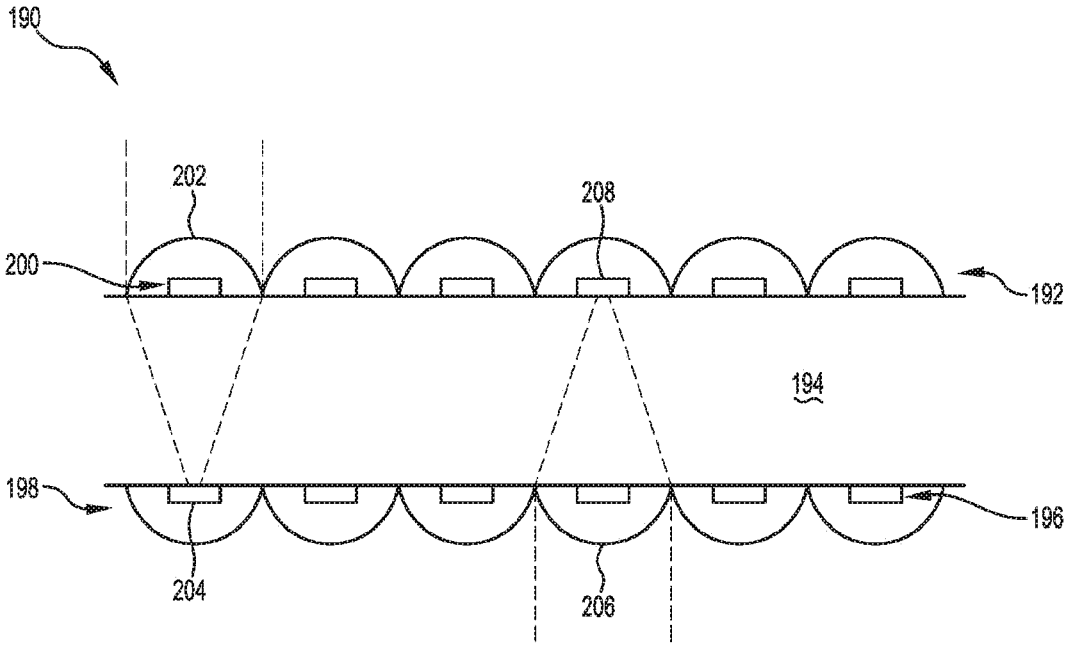

FIG. 10 shows a "double-sided" device 190 includes an array 192 of focusing elements applied to a first side of a transparent or partially transparent substrate 194 and a corresponding array of image elements 196 applied to a second side of the substrate 194. However, the micro-optic device 190 further includes an array 198 of focusing elements applied to the second side of the substrate 194 and a corresponding array of image elements 200 applied to the first side of the substrate 194.

Each focusing element on the first side of the substrate—such a focusing element 202—focuses light to a focal point on the image plane and magnifies any portion of an image element on the second side of the substrate—such as image element 204—falling within the focal point to thereby produce an image pixel projected to a user at one or more viewing angles from the first side of the substrate. Similarly, each focusing element on the second side of the substrate—such as focusing element 206—focuses light to a focal point on the image plane and magnifies any portion of an image element on the first side of the substrate—such as image element 208—falling within the focal point to thereby produce an image pixel projected to a user at one or more viewing angles from the second side of the substrate.

The topography of the focusing elements may have a variety of profiles including circular, elliptical, parabolic and conical. The focusing elements can also be arranged "packed" in any convenient manner, including in a rectangular or hexagonal array. With respect to two-dimensional arrays, any two-dimensional Bravais lattice arrangements are suitable. Image elements are preferred to be arranged in the same arrangement as that of the focusing elements.

In different embodiments, the focusing elements may be refractive, reflective or diffractive. In embodiments, where the focusing elements are reflective, they may conveniently be over-coated with at least a thin layer of at least partially reflective material to enable them to function as reflective focusing elements.

Embodiments of the invention described above are, generally, described as being partly formed by the embossing of structures into a UV curable material. Whilst this is the preferable method of forming the unitary structures, the embodiments are not limited to that method of manufacture only and may also be formed by alternative process steps to generate the same structures. For example, the structures may also be formed by printing, etching or any other suitable method of manufacture. They also may be formed in other radiation curable materials or by direct embossing into suitable pliable materials. The structures may be formed separately, such as on a foil, and laminated or hot stamped on to a substrate.

The focusing elements and image elements can be formed by any suitable manufacturing process, including the following non-limiting exemplary security print processes: offset, foil application, screen printing, intaglio, letterpress and overcoating. In the embodiments described herein, an embossing shim can used to emboss the unitary structure, including a focusing structure of focusing elements and an imagery structure of image elements, on one or both sides of the substrate.

However, the image elements and the focusing elements need not be formed in two separate steps or form part of different structures. In addition to being formed from one or more layers of printed ink, the image elements and/or image sub-elements may have a topography including one or more of the following attributes:

a) recessed relative to adjacent surfaces;
b) raised/protruding/extending above adjacent surfaces;
c) a constant height;
d) a diffraction grating;
e) a high roughness surface texture (for example optically diffuse/light scattering);
f) a low roughness surface texture (for example optically smooth/flat);
g) a light-extinguishing texture (for example high frequency/high aspect ratio structure which "extinguishes" the light intensity by causing the light to undergo a high number of total internal reflections i.e. compounding attenuation of the light amplitude via multiple reflections);

h) a surface perturbation/mathematical function of the focussing element topography; and i) tapered side walls to allow easy release from an embossing tool.

In one or more embodiments, the image elements may also be over printed with the coloured ink in a subsequent process, particularly if the image elements are raised, protruding and/or extending above the adjacent focusing elements.

Figure 11:
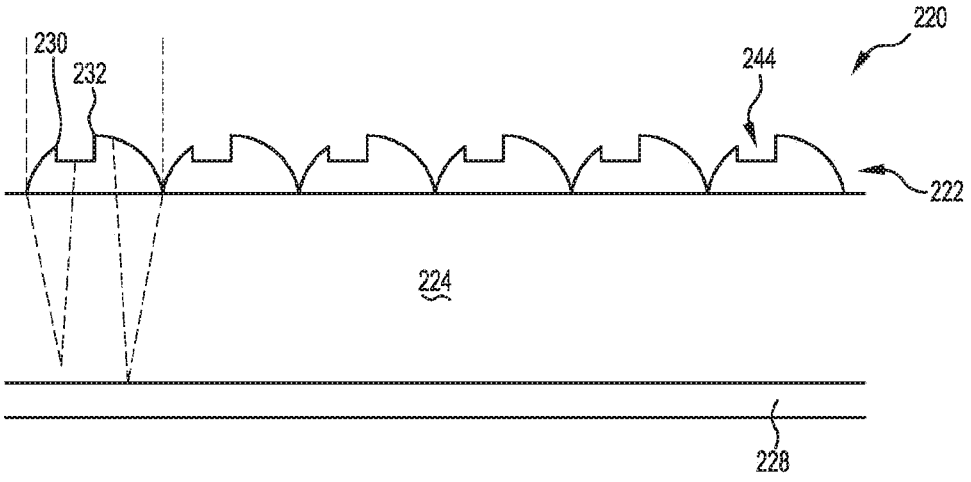

The focusing elements and the image elements upon which they focus light need not be on opposite side of the substrate. FIG. 11 depicts a "single-sided" micro-optic device 220 which includes an array 222 of focusing elements applied to a first side of a transparent or partially transparent substrate 224 and a corresponding array of image elements 226 applied to that same first side of the substrate 224. In this case, the focusing elements 222 and image elements 226 are embossed by the process described in relation to FIGS. 1 and 2 as part of a unitary structure. In this case, a layer 228 of reflective material is formed on the second side of the substrate to direct light from the focusing elements—such as focusing element 230—to the image elements—such as image element 232.

In other embodiments, the image elements 226 could be replaced with image elements that are simply printed onto the same side of the substrate as the focusing elements.

Figure 12:
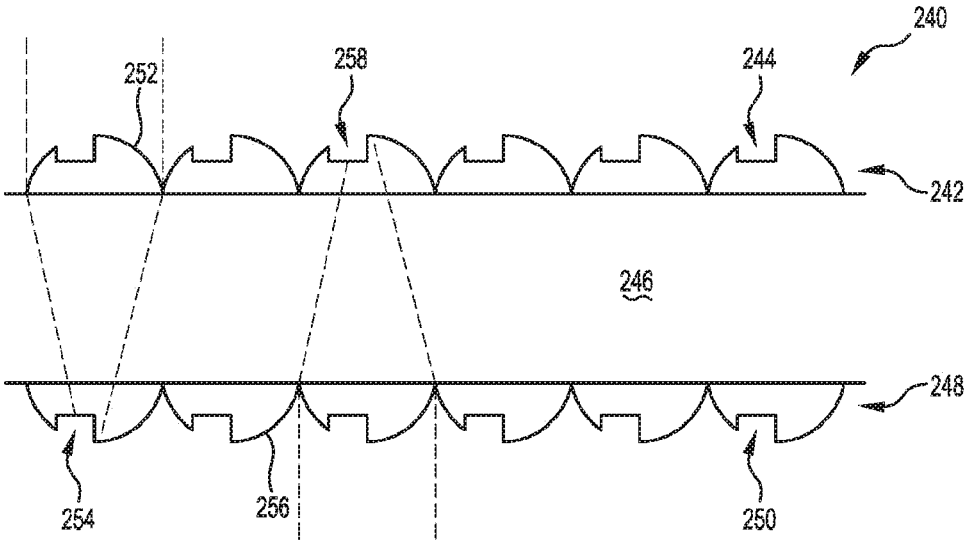

FIG. 12 depicts a "double-sided" micro-optic device 240 which includes an array 242 of focusing elements and an array of image elements 244 applied to a first side of a transparent or partially transparent substrate 246 as part of a first unitary structure. In addition, the micro-optic device 240 includes an array 248 of focusing elements and an array 250 of image elements applied to the second side of the substrate 246 as part of a second unitary structure.

Each focusing element on the first side of the substrate—such a focusing element 252—focuses light to a focal point on the image plane and magnifies any portion of an image element on the second side of the substrate—such as image element 254—falling within the focal point to thereby produce an image pixel projected to a user at one or more viewing angles from the first side of the substrate. Similarly, each focusing element on the second side of the substrate—such as focusing element 256—focuses light to a focal point on the image plane and magnifies any portion of an image element on the first side of the substrate—such as image element 258—falling within the focal point to thereby produce an image pixel projected to a user at one or more viewing angles from the second side of the substrate.

Where the terms "comprise", "comprises", "comprised" or "comprising" are used in this specification (including the claims) they are to be interpreted as specifying the presence of the stated features, integers, steps or components, but not precluding the presence of one or more other features, integers, steps or components, or group thereof.

It will be understood that the invention is not limited to the specific embodiments described herein, which are provided by way of example only. The scope of the invention is as defined by the claims appended hereto.

What is claimed is:

1. A micro-optic device for projecting an image, the device including:

a substrate;

a plurality of image elements, arranged on the substrate, in an image plane; and a plurality of focusing elements arranged in a two dimensional array on the substrate, each focusing element focusing light to a focal point on the image plane and magnifying any portion of an image element falling within the focal point to thereby produce a projected image pixel projected to a user at a plurality of viewing angles, the focal point having an extent smaller than the image element, wherein:

each image element including an image sub-element discernible from elsewhere in the image element, brightness of each projected image pixel being dependent on a proportion of the focal point filled with the image sub-element, each image sub-element has one or more attributes in the image plane and the or each attribute corresponds to a pre-defined brightness at a particular angle of view, such that the projected image pixels together project the image, and at other angles of view the brightness of the projected image pixel varies, in a defined relationship according to the or each attribute, and wherein image pixels having a same brightness at a particular angle of view are produced by image elements having sub-elements with identical attributes, and a first attribute of each image sub-element is a function of a grey-level value of a location corresponding to the image sub-element in a first greyscale image.

2. The micro-optic device of claim 1, wherein the proportion of the focal point filled with the image sub-element changes when seen from different viewing angles.

3. The micro-optic device of claim 1, wherein a second attribute of each image sub-element is a function of a grey-level value of a location corresponding to that image sub-element in a second greyscale image.

4. The micro-optic device of claim 1, wherein the one or more attributes of the image sub-elements include any one or more of angular orientation, shape, thickness, length and area.

5. The micro-optic device of claim 1, wherein each image sub-element has a shape, and wherein one of the attributes is an angular orientation of the shape.

6. The micro-optic device of claim 4, wherein each image sub-element has the same shape.

7. The micro-optic device of claim 1, wherein each image sub-element is a half disk occupying half of an image element.

8. The micro-optic device of claim 5, wherein the device produces a contrast switching effect when seen from different viewing angles.

9. The micro-optic device of claim 1, wherein each image sub-element has a shape, and wherein one of the attributes is an area of the shape.

10. The micro-optic device of claim 9, wherein the device produces a disappearing image effect when seen from different viewing angles.

11. The micro-optic device of claim 1, wherein the plurality of image elements and the plurality of focusing elements are located on opposite sides of the substrate.

12. The micro-optic device of claim 1, wherein the plurality of image elements and the plurality of focusing elements are located on a first side of the substrate, the micro-optic device further including a layer of reflective material to direct light from the focusing elements to the image elements.

13. The micro-optic device of claim 1, wherein a first group of the focusing elements and a first group of the image elements are integrated into a first unitary structure on a first side of the substrate.

14. The micro-optic device of claim 13, wherein a second group of the focusing elements and a second group of the image elements are integrated into a second unitary structure on a second side of the substrate, and wherein the first group of the focusing elements causes the second group of the image elements to be magnified.

15. The micro-optic device of claim 1, wherein the image sub-elements are formed by any one of gravure, flexographic and offset printing techniques.

16. The micro-optic device of claim 1, wherein the image sub-elements are formed by embossing or other microstructure forming technique.

17. The micro-optic device of claim 16, wherein the image sub-elements are recessed or protrude from surrounding surfaces.

18. The micro-optic device of claim 1, wherein the image sub-elements include any one or more of gratings, microtexture and textured microstructures.

19. The micro-optic device of claim 1, wherein the image sub-elements have a surface that is oblique relative to a plane of surrounding surfaces.

20. The micro-optic device of claim 1, wherein the plurality of image elements and the plurality of focusing elements each form a two-dimensional array.

21. A security device including the micro-optic device of claim 1.

22. A security document including the security device of claim 21.

* * * * *